US007438279B2

(12) United States Patent
Eby et al.

(10) Patent No.: US 7,438,279 B2
(45) Date of Patent: Oct. 21, 2008

(54) TOOL FOR PULLING NAILS AND OTHER PROTRUSIONS

(75) Inventors: Eric H. Eby, Lone Rock, WI (US); Rick Parduhn, Richland Center, WI (US); Robert T. Schofield, Brooklyn, WI (US); James C. Boda, Merrimac, WI (US)

(73) Assignee: Halvor, Inc., Lone Rock, WI (US)

( * ) Notice: Subject to any disclaimer, the term of this patent is extended or adjusted under 35 U.S.C. 154(b) by 0 days.

(21) Appl. No.: 11/623,200

(22) Filed: Jan. 15, 2007

(65) Prior Publication Data

US 2007/0114501 A1 May 24, 2007

Related U.S. Application Data

(63) Continuation-in-part of application No. 11/242,263, filed on Oct. 3, 2005, which is a continuation-in-part of application No. 11/070,470, filed on Mar. 1, 2005, now Pat. No. 6,986,504.

(51) Int. Cl.
*B66F 15/00* (2006.01)

(52) U.S. Cl. ..... 254/25; 81/20

(58) Field of Classification Search ..... 254/25, 254/26 R, 131, 18; 81/20, 177, 8, 119, 180, 81/1

See application file for complete search history.

(56) References Cited

U.S. PATENT DOCUMENTS

| | | | | |
|---|---|---|---|---|
| 120,304 | A | 10/1871 | McBride | |
| 1,709,240 | A | 4/1929 | Wass | |
| 2,525,226 | A | 10/1950 | Lawellin | |
| 4,614,001 | A * | 9/1986 | Liou | 7/137 |
| 5,033,140 | A | 7/1991 | Chen et al. | |
| 5,249,776 | A | 10/1993 | Johnson | |
| 5,871,204 | A | 2/1999 | Spirer | |
| 5,931,063 | A * | 8/1999 | Kuo | 81/119 |
| 6,105,935 | A | 8/2000 | Wagner | |
| 6,266,834 | B1 * | 7/2001 | Walsh et al. | 7/144 |
| 6,279,876 | B1 * | 8/2001 | Massie | 254/26 E |

(Continued)

FOREIGN PATENT DOCUMENTS

| | | | |
|---|---|---|---|
| CH | 302999 | A | 11/1954 |

(Continued)

OTHER PUBLICATIONS

International Search Report for PCT/US2006/005627 issued Jul. 14, 2006 by the European Patent Office.

*Primary Examiner*—Lee D Wilson
(74) *Attorney, Agent, or Firm*—Craig A. Fieschko, Esq.; DeWitt Ross & Steven S.C.

(57) ABSTRACT

A pulling tool for pulling nails, screws, rivets, pegs, or other protrusions includes a jaw which may be opened to receive the head of the protrusion. The jaw is then at least partially closed against the protrusion, and when the handle of the tool is pulled, the jaw is both urged shut and also away from the surface from which the protrusion extends. Thus, as the protrusion is pulled, its shaft is also more tightly grasped, which helps to pull the protrusion from the surface without stripping off its head/cap. The pulling tool can be provided as a part of a hammer, crowbar, or other conventional tool.

20 Claims, 5 Drawing Sheets

U.S. PATENT DOCUMENTS

| | | | | |
|---|---|---|---|---|
| 6,289,966 | B1 * | 9/2001 | Hoermann | 160/191 |
| 6,314,599 | B1 | 11/2001 | Hay | |
| 6,733,001 | B2 | 5/2004 | Wagner | |
| 6,827,333 | B1 | 12/2004 | Lutz | |
| 6,986,504 | B1 * | 1/2006 | Eby et al. | 254/25 |
| 7,025,331 | B2 * | 4/2006 | Whelan | 254/25 |
| 7,118,093 | B2 | 10/2006 | Wagner | |
| 2004/0069978 | A1 | 4/2004 | Whetan | |
| 2005/0076748 | A1 | 4/2005 | Tremblay et al. | |
| 2007/0114501 | A1 * | 5/2007 | Eby et al. | 254/25 |

FOREIGN PATENT DOCUMENTS

| | | | |
|---|---|---|---|
| CH | 615110 | A | 1/1980 |
| DE | 79 02 544 | U1 | 3/1980 |
| GB | 472361 | A | 9/1937 |
| GB | 2286791 | A | 8/1995 |
| GB | 2313802 | A | 12/1997 |

* cited by examiner 200
210
218
222
208
220
214
212
206
232
204b
230
216
204
204a 210
208
214
218
222
220
206
212
204b
216
204
204a
226
202
228
224
200

218
206
222
208
214
210
220
212
216
204
204a
226
200
228
224
202

TOOL FOR PULLING NAILS AND OTHER PROTRUSIONS

CROSS-REFERENCE TO RELATED APPLICATIONS

This application is a continuation-in-part of U.S. patent application Ser. No. 11/242,263 filed 3 Oct. 2005, which is itself a continuation-in-part of Ser. No. 11/070,470 filed 1 Mar. 2005 (now U.S. Pat. No. 6,986,504), with the entireties of these prior applications being incorporated by reference herein.

FIELD OF THE INVENTION

This document concerns an invention relating generally to hand tools, and more specifically to hand tools which allow the pulling of nails or other small protrusions (screw or rivet heads, nuts, pegs, etc.) from the surfaces from which they protrude.

BACKGROUND OF THE INVENTION

Claw hammers are perhaps the best known tool for pulling nails from boards or other surfaces. The claw hammer has a curved top bearing surface which ends in a furcated tail or "claw" opposite the hammer head. When a nail is to be pulled, the nail head is situated between the furcations, and the top bearing surface is rolled along the board (or other surface from which the protrusion extends) in a tail-to-head direction so that the curvature of the bearing surface lifts the furcations (and thus the nail head) from the board. The problem with this arrangement is that the cap of the nail head—which bears against the furcations of the hammer tail, with the nail shaft resting in the crotch between the furcations—may yield if the nail is firmly grasped by the board, effectively stripping the nail cap from the nail head. The furcations are then unable to grasp the nail head, and the claw hammer can no longer pull the nail. Thus, claw hammers are often ineffective in pulling nails or other protrusions where such protrusions lack sturdy, well-defined caps (or where they lack other heads of greater diameter than the adjacent part of the protrusion).

SUMMARY OF THE INVENTION

The invention involves a pulling tool for pulling out embedded nails and other protruding objects, with the invention being intended to at least partially solve the aforementioned problems by positively grasping the nail during pulling, as opposed to passively doing so as in a claw hammer. To give the reader a basic understanding of some of the advantageous features of the invention, following is a brief summary of the preferred versions 500 and 600 of the pulling tool shown in FIGS. 5*a*-5*b* (which will be collectively referred to as FIG. 5) and FIGS. 6*a*-6*b* (which will be collectively referred to as FIG. 6). As this is merely a summary, it should be understood that more details regarding the preferred versions may be found in the Detailed Description set forth elsewhere in this document. The claims set forth at the end of this document then define the various versions of the invention in which exclusive rights are secured.

Preferred versions of the pulling tool 500/600 include a tool head 504/604 with an elongated handle 502/602 at its tool head bottom 504*a*/604*a* and an anchor 506/606 fixed with respect to the handle 502/602 at its tool head top 504*b*/604*b*, and a jaw 508/608 which is pivotable with respect to the tool head 504/604 and anchor 506/606. The jaw 508/608 includes a jaw bearing surface 510/610 which extends between a jaw tip 512/612 and a jaw tail 514/614; a cutout 518/618 (e.g., an aperture in the jaw 508/608) extending through the jaw 508/608 from the bearing surface 510/610; and a jaw grasping face 520/620 which rests adjacent the jaw bearing surface 510/610, and which bounds one side of the cutout 518/618. A jaw grasping edge 542/642, which is preferably sharp (e.g., wedge/chisel-shaped), is situated between the jaw grasping face 520/620 and the jaw bearing surface 510/610. The anchor 506/606 includes an anchor bearing surface 544/644 at its end, with an anchor grasping face 546/646 (FIGS. 5*b* and 6*b*) being situated adjacent the anchor bearing surface 544/644. An anchor grasping edge 548/648 (FIGS. 5*b* and 6*b*), which is preferably sharp, is also situated between the anchor grasping face 546/646 and the anchor bearing surface 544/644.

The jaw 508/608 pivots with respect to the anchor 506/606 at a pivot 516/616 between an open state (FIGS. 5*b* and 6*b*) and a closed state (FIGS. 5*a* and 6*a*). In the open state, an open mouth 522/622 is defined between the jaw bearing surface 510/610 and the anchor bearing surface 544/644 (and between the jaw grasping face 520/620 and the anchor grasping face 546/646), allowing a nail or other protrusion to be inserted into (or removed from) the mouth 522/622. As the jaw 508/608 is moved from the open state to the closed state, the anchor 506/606 moves toward the jaw grasping face 520/620 so that a nail or other protrusion may be grasped in the mouth 522/622 (i.e., between the jaw grasping edge 542/642 and the anchor grasping edge 548/648).

To pull a nail extending from a board, or to grasp and pull another protrusion (e.g., a peg, rivet head, protruding nut, etc.), the jaw 508/608 is pivoted to its open state and the protrusion is inserted in the open mouth 522/622 against the jaw grasping face 520/620, and the surrounding jaw bearing surface 510/610 may be situated upon the board or other surface from which the protrusion extends. The handle 502/602 (and the affixed anchor 506/606) may then be pivoted with respect to the jaw 508/608 such that the jaw 508/608 moves to its closed state, and the mouth 522/622 closes about the protrusion. The handle 502/602 of the pulling tool may then be further pivoted so that the jaw bearing surface 510/610 (and anchor bearing surface 544/644) rolls across the surface from which the protrusion extends, with the bearing surfaces 510/610 and 544/644 being curved to accommodate such rolling. Such rolling starts with the regions of the jaw bearing surface 510/610 nearer a jaw tip 512/612 contacting the board or other surface from which the protrusion extends, and ends with regions of the jaw bearing surface 510/610 nearer a jaw tail 514/614 contacting the board/surface. Owing to the curvature of the jaw bearing surface 510/610, this action begins lifting the mouth 522/622 away from the surface from which the protrusion extends, and at the same time, the jaw tail 514/614 presses against the surface, thereby serving to more firmly close the mouth 522/622 about the protrusion. As a result, the harder one attempts to pull a nail or other protrusion, the more fly the jaw 508/608 is urged shut, and the more tightly the protrusion is grasped. This positive grip even allows the pulling tools 500/600 to pull headless nails out of boards, since the grasp of their jaws 508/608 on a headless nail shaft is sufficiently strong to allow the nail to be pulled.

A particular advantage of the pulling tools 500/600 is that they are able to pull nails or other protrusions in hard-to-reach areas where conventional claw hammers can't reach—for example, they are able to grasp and pull nail heads which are closely spaced to some obstruction (e.g., where the nail head is protruding from a surface near an inner corner). This is because the lateral anchor grasping face sides 550/650 and lateral jaw grasping face sides 552/652 laterally bound the tool head 504/604 and jaw 508/608, and they are in alignment (or nearly so) when the jaws 508/608 are in the closed state. Thus, even when a nail head is protruding from a surface immediately adjacent some obstruction, one may simply situate the lateral anchor grasping face sides 550/650 and lateral jaw grasping face sides 552/652 against the obstruction, and use the pulling tool 500/600 to pull the nail head in standard fashion.

It is seen from FIGS. 5 and 6 (as well as the remaining drawings) that pulling tools having the foregoing features may adopt a variety of configurations. The pulling tool 500 of FIG. 5 takes the general form of a hammer, with the jaw tip 512 defining a furcated claw, and the jaw tail 514 defining a hammer head. The pulling tool 500 may therefore be used as a conventional hammer as well as a pulling tool. In contrast, the pulling tool 600 of FIG. 6 is intended to be compactly sized, and is intended to be used for cabinetry finishing and similar purposes, with the handle 602 terminating in a wedge/chisel-shaped end 624 which can be used for prying apart boards, lifting mail heads, etc.

Further advantages, features, and objects of the invention will be apparent from the following detailed description of the invention in conjunction with the associated drawings.

DETAILED DESCRIPTION OF PREFERRED VERSIONS OF THE INVENTION

Figure 1A:
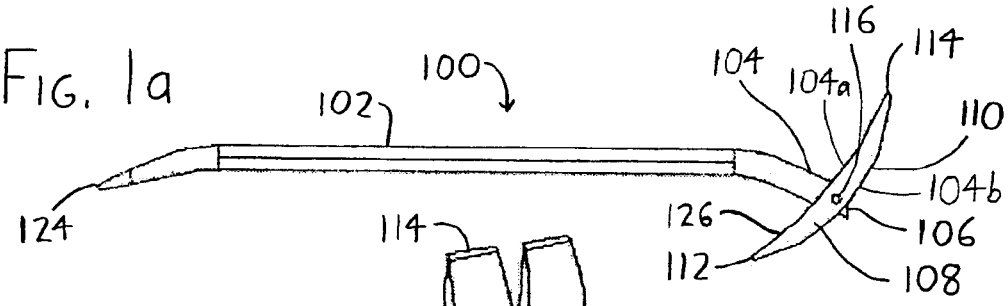
FIGS. 1*a*-1*d* present perspective views of a first version of a pulling tool which exemplifies the invention, wherein the pulling tool is provided in the form of a crowbar 100 (or more accurately a crowbar head), with FIGS. 1*a* and 1*b* showing the jaw 108 in the open state (with the mouth 122, FIG. 1*b*, being open to receive a nail head or other protrusion), and FIGS. 1*c* and 1*d* showing the jaw 108 in the closed state.
Figure 1B:
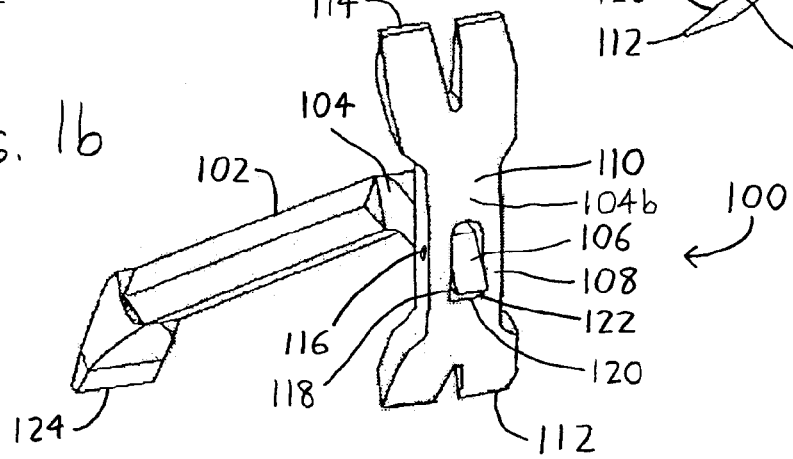
Figure 1C:
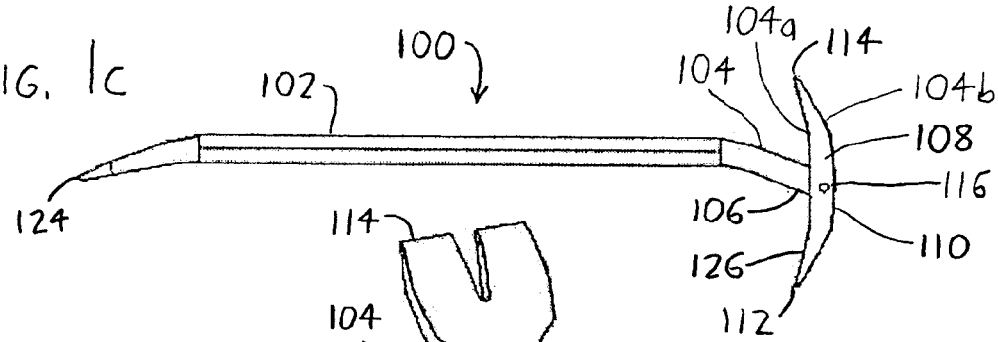
Figure 1D:
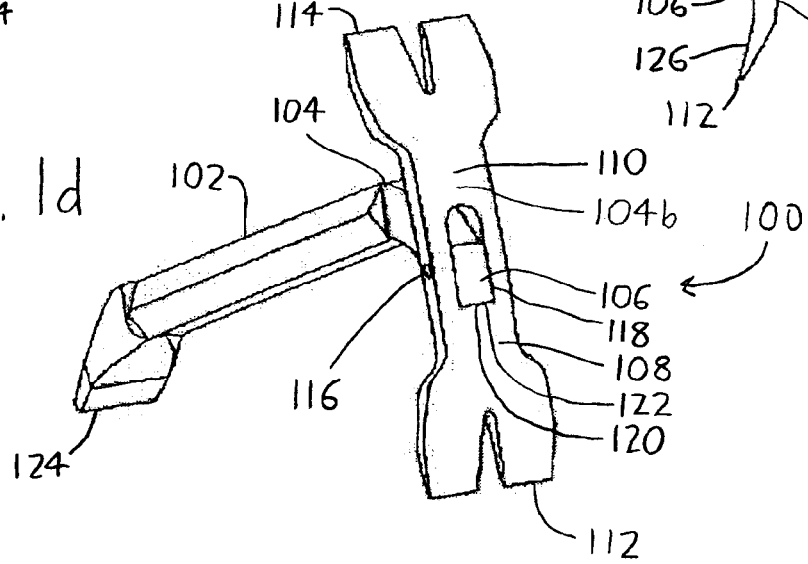

Referring initially to FIGS. 1*a*-1*d* (which are collectively referred to as FIG. 1), the pulling tool is presented in the form of a crowbar 100. The crowbar 100 has a tool head 104 with an elongated handle 102 extending from its tool head bottom 104*a*, with the handle 102 terminating in a prying wedge 124 at its opposite end. The tool head top 104*b* defines an anchor 106 against which a nail or other protrusion will be grasped, and it includes a jaw 108 which is pivotally affixed to the anchor 106 at pivot 116. The jaw 108 includes a jaw tip 112 and an opposing jaw tail 114, both of which are preferably defined as furcated prying wedges. A top jaw bearing surface 110 curves in an arc from the jaw tip 112 to the jaw tail 114. An opposing jaw bottom surface 126 (FIGS. 1*a* and 1*c*), which faces the handle 102, also extends between the jaw tip 112 and the jaw tail 114. A cutout 118, defined as an aperture extending between the jaw bearing surface 110 and the jaw bottom surface 126, is situated between the jaw tip 112 and the jaw tail 114. One side of the cutout 118 is bounded by a jaw grasping face 120 which is situated adjacent to the pivot 116, and which faces toward the jaw tail 114. The anchor 106 of the tool head 104 is pinned by the pivot 116 within the cutout 118, and between the jaw tip 112 and jaw tail 114, such that the jaw 108 can pivot 116 between an open state (FIGS. 1*a*-1*b*) and a closed state (FIGS. 1*c*-1*d*). In the open state, an open mouth 122 (FIG. 1*b*) is defined in the jaw bearing surface 110 between the jaw grasping face 120 and the anchor 106, allowing a nail or other protrusion to be inserted into (or removed from) the mouth 122. As the jaw 108 is pivoted from the open state to the closed state, the anchor 106 moves further into the cutout 118 of the jaw 108 and toward the jaw grasping face 120 until it sits closely adjacent the jaw grasping face 120. At this point, the mouth 122 is at least substantially closed, and a nail or other protrusion previously inserted into the open mouth 122 may be grasped in the mouth 122 between the anchor 106 and the jaw grasping face 120. Both the jaw grasping face 120 and the opposing face of the anchor 106 are preferably oriented at least substantially perpendicular to the jaw bearing surface 110 when the jaw 108 is in its closed state so as to better grasp a nail head or other protrusion when the jaw bearing surface 110 rests against the surface from which the protrusion extends (it being assumed that such a protrusion will usually protrude perpendicularly from such a surface).

To pull a nail extending from a board (or to grasp and pull another protrusion), the jaw 108 is pivoted to its open state (FIGS. 1*a*-1*b*) and the protrusion is inserted in the open mouth 122 against the jaw grasping face 120, and the surrounding jaw bearing surface 110 of the jaw 108 may be situated upon the board or other surface from which the protrusion extends. The handle 102 is then pivoted so that the jaw 108 is in its closed state (FIGS. 1*c*-1*d*) such that the mouth 122 closes about the protrusion, with the protrusion being sandwiched between the anchor 106 and the jaw bearing surface 110. The handle 102 of the pulling tool 100 may then be pulled so that the handle 102 travels in the direction in which the jaw tail 114 points/extends, with the jaw bearing surface 110 rolling across the surface from which the protrusion rises. Owing to the curvature of the jaw bearing surface 110, this rolling action begins lifting the mouth 122 away from the surface from which the protrusion extends, thereby pulling the nail or other protrusion. At the same time, as the jaw bearing surface 110 rolls across the surface from which the protrusion extends (with the jaw bearing surface 110 rolling from its regions nearer its jaw tip 112 towards regions nearer its jaw tail 114), the pressure of the jaw tail 114 against the surface from which the protrusion extends will force the jaw 108 closed, thereby serving to more firmly clamp the mouth 122 about the protrusion. As a result, the harder one attempts to pull a nail or other protrusion, the more firmly it is grasped between the jaw bearing surface 110 and the anchor 106. By continuing to roll the jaw bearing surface 110 across the surface from which the protrusion extends, the protrusion will be pulled from the surface. The crowbar 100 can then be removed from the surface, and the jaw 108 may be pivoted to its open state to release and discard the protrusion.

The crowbar 100 is also usable as a standard crowbar 100. Here, where the head of the crowbar 100 is to be used in standard fashion, the jaw 108 is simply pivoted into its closed state (FIGS. 1*c*-1*d*) so that the anchor 106 bears against the jaw grasping face 120. When the jaw tip 112 is then used to pry objects apart, the jaw 108 is effectively held immobile with respect to the handle 102 so that the jaw 108 will not yield during crowbar use.

Figures 2A, 2B, 2C:
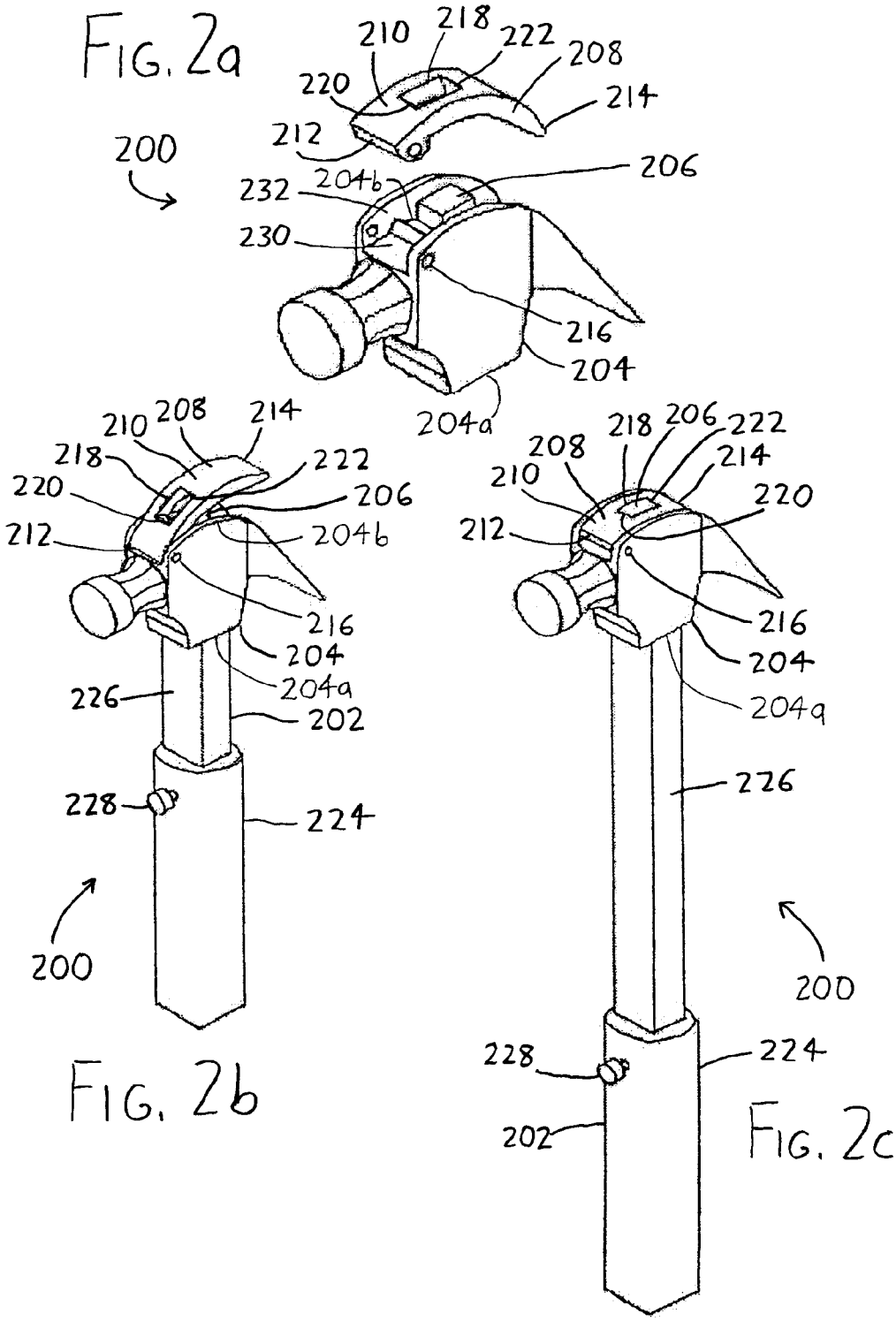
FIGS. 2*a*-2*c* present perspective views of a second version of a pulling tool which exemplifies the invention, wherein the pulling tool is provided in the form of a hammer 200 (or more accurately a hammer head), with FIG. 2*a* presenting an exploded (disassembled) perspective view of the head of the hammer 200, FIG. 2*b* showing the jaw 208 in the open state (with the mouth 222 being open to receive a nail head or other protrusion), and FIG. 2*c* showing the jaw 208 in the closed state.
Figure 3A:
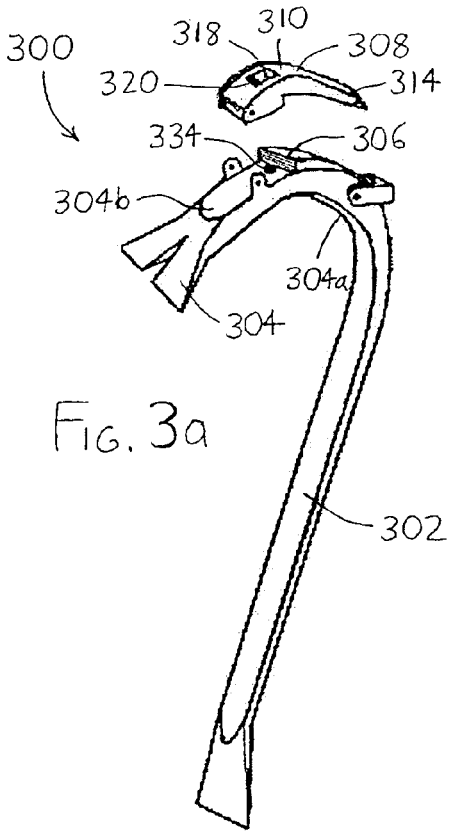
FIGS. 3*a*-3*b* present perspective views of a third version of a pulling tool which exemplifies the invention, wherein the pulling tool 300 resembles a crowbar with the jaw assembly 200 of FIG. 2 being attached, with FIG. 3*a* showing the jaw 308 exploded from the tool head 304 and FIG. 3*b* showing a fully assembled version.
Figure 3B:
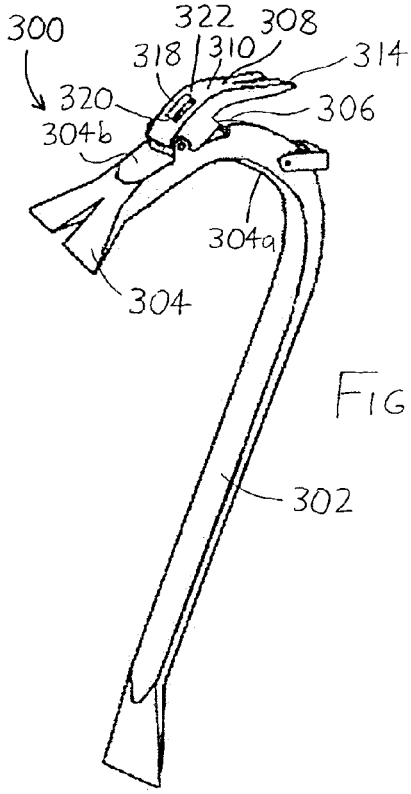

Referring then to FIGS. 2*a*-2*c* (which are collectively referred to as FIG. 2), the pulling tool is presented in the form of a hammer 200 (or more accurately a hammer head, as depicted in FIG. 2*a*, which is preferably provided in conjunction with the handle 202 depicted in FIGS. 2*b*-2*c*). The handle 202 usefully includes a sleeve 224 which may be telescopically extended from the handle shaft 226 as shown in FIGS. 2*b*-2*c*, and which may be fastened at a desired extension by a threaded fastener 228 extending through the sleeve 224 to engage the handle shaft 226. Such an extendible handle 202 allows a user to attain better leverage when using the hammer 200 to pull a nail or other protrusion.

The hammer head includes an anchor 206 (best seen in FIG. 2*a*) which is fixed at the top 204*b* of the tool head 204, and is therefore also fixed with respect to the handle 202 extending from the tool head bottom 204*a*. The anchor 206 is defined as a block protruding from a depressed head surface 230 (also best seen in FIG. 2*a*) and spaced from opposing flange-like head sides 232 which rise from the head surface 230. A jaw 208 is pivotally affixed to the head sides 232 at a pivot 216 provided on the jaw tip 212. and the jaw 208 further includes a jaw tail 214 opposite the jaw tip 212, a top jaw bearing surface 210 curving in an arc between the jaw tip 212 and the jaw tail 214, and a lower jaw surface (not shown) between the jaw tip 212 and the jaw tail 214 and opposite the jaw bearing surface 210. The jaw 208 can thereby rotate about the pivot 216 toward and away from the anchor 206.

A cutout 218 is defined in the jaw 208 between its jaw bearing surface 210 and its lower jaw surface, and between the jaw tip 212 and the jaw tail 214. One side of the cutout 218 is bounded by a jaw grasping face 220 which is situated adjacent to the pivot 216 and which faces toward the jaw tail 214. When the jaw 208 pivots from its open state (shown in FIG. 2*b*) with its tail 214 spaced from the depressed head surface 230, to its closed state (shown in FIG. 2*c*) with its tail 214 closely adjacent to the depressed head surface 230, the anchor 206 moves into the cutout 218 to be complementarily received therein. Thus, when the jaw 208 is in its open state, an open mouth 222 is defined in the jaw bearing surface 210 between the jaw grasping face 220 and the anchor 206, allowing a nail or other protrusion to be inserted into (or removed from) the mouth 222. As the jaw 208 is moved from the open state to the closed state, the anchor 206 moves into the cutout 218 of the jaw 208 and toward the jaw grasping face 220 until it sits closely adjacent the jaw grasping face 220. At this point, the mouth 222 is at least substantially closed and a nail or other protrusion may be grasped in the mouth 222 (i.e., between the anchor 206 and the jaw grasping face 220). The jaw grasping face 220, as well as the face of the anchor 206 against which the jaw grasping face 220 rests when the jaw 208 is in its closed state, are preferably oriented at least substantially perpendicular to the jaw bearing surface 210 to better grasp any protrusion situated in the mouth 222.

To use the hammer 200 to pull a nail (or another protrusion) extending from a board or other surface, a user may use the furcated claw of the hammer 200 in standard fashion (the furcations not being visible in FIG. 2), or may instead use the jaw 208. The jaw 208 is pivoted to its open state (FIG. 2*b*) and the protrusion is inserted against the jaw grasping face 220 in the open mouth 222. The surrounding jaw bearing surface 210 of the jaw 208 is situated upon the board or other surface from which the protrusion extends. The jaw 208 is then pivoted toward its closed state such that the mouth 222 closes about the protrusion, with the protrusion being sandwiched between the jaw grasping face 220 and the anchor 206. The handle 202 of the pulling tool may then be pulled so that the handle 202 travels in the direction in which the jaw tail 214 (and the claw of the hammer 200) points, with the jaw bearing surface 210 rolling across the surface from which the protrusion extends. Owing to the curvature of the jaw bearing surface 210, the mouth 222 begins lifting away from the surface from which the protrusion extends, thereby pulling the protrusion from its surrounding surface. At the same time, the pressure on the jaw bearing surface 210 at the jaw tail 214 serves to more firmly close the mouth 222 about the protrusion. As a result, the harder one pulls the nail or other protrusion, the more firmly it is grasped during such pulling.

From the differing configurations of the crowbar 100 and the hammer 200, it should be understood that the general configuration of the pulling tool can vary substantially (and can vary quite substantially from the versions shown in the accompanying drawings). It is emphasized that the depicted crowbar 100 and hammer 200 are merely exemplary, and various modifications are also considered to be within the scope of the invention. As examples, the size and configuration of the jaw 108/208 can vary substantially, and as the foregoing examples show, the location of the pivot 116/216 be changed. The cutout 118/218 need not be provided as an aperture bounded by the jaw 108/208 on all sides, but could rather be provided as a slot which extends inwardly from one of the sides of the jaw 108/208, as well as from its jaw bearing surface 110/210 to its jaw bottom surface (though this arrangement is not preferred). The jaw grasping face 120/220 need not be perpendicular to the adjacent jaw bearing surface 110/210, and could instead define a wedge- or chisel-shaped face (which may slightly protrude above the surrounding surface of the jaw 108/208), so that the jaw grasping face 120/220 may "dig" beneath the cap of a nail or other fastener to better grip it. Additionally, the jaw grasping face 120/220 may be notched or furcated so that the notch may receive the shaft of a nail or other protrusion. Alternatively, the jaw grasping face 120/220 could have a sharpened wedge- or chisel-shaped face so that a protrusion is cut off by the pulling tool rather than pulled. Additionally or alternatively, the face of the anchor 106/206 which opposes the jaw grasping face 120/220 (and abuts the jaw grasping face 120/220 when the jaw 108/208 is in its closed state) could also have a notched/furcated surface, or a sharpened surface, to attain the foregoing objectives. The jaw bearing surface 110/210 need not be curved, but can simply be formed as (for example) a flat surface whereby a protrusion is pulled not so much by a rolling action, but more of a levering action. Additionally, the jaw bearing surface 110/210 need not be continuous (i.e., it might include a valley or other depression formed therein), though it preferably has a continuous contour/curvature so that any rolling action generated by the jaw bearing surface is smooth.

To illustrate one possible variant of the jaws 108/208 of FIGS. 1*a*-1*d* and 2*a*-2*c*, FIGS. 3*a*-3*b* illustrate an alternative form of the crowbar 100 of FIG. 1 in combination with an alternative form of the jaw 208 of the hammer 200 of FIG. 2. In the crowbar 300, the handle 302 is integrally formed with the tool head 304 to extend from the tool head bottom 304*a*. The anchor 306 takes the form of a ledge at the tool head top 304*b* which does not fit complementarily within the cutout 318. A hole or other depression 334 (FIG. 3*a*) may be situated adjacent the anchor 306 so that a nail head or other protrusion may be fit within the cutout 318 of the open jaw 308, and further into the hole 334 (if desired). Closing the jaw 308 causes its grasping face 320 to grasp the protrusion against the anchor 306, and when the handle 302 of the crowbar 300 is pulled so that the handle 302 travels in the direction in which the jaw tail 314 points, the jaw bearing surface 310 will roll across the surface from which the protrusion extends, thereby lifting the mouth 322 (FIG. 3*b*) away from the surface from which the protrusion extends and pulling the protrusion from its surrounding surface. A rotatable clip 336 is also provided to allow a user to engage the jaw tail 314 to the tool head 304 and handle 302 when the user wishes to simply use the pulling tool 300 as a conventional crowbar.

Figure 4:
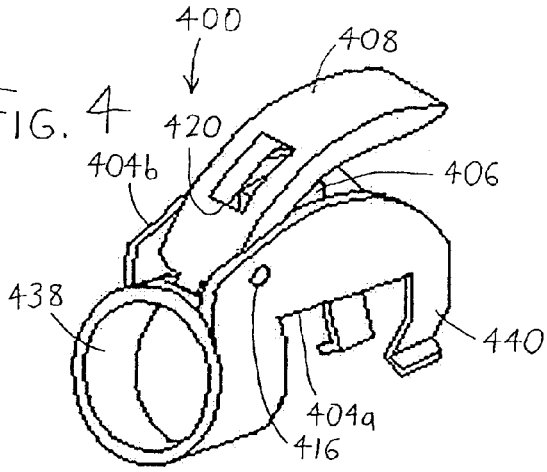
FIG. 4 presents a perspective view of a fourth version of a pulling tool which exemplifies the invention, wherein the pulling tool is provided in the form of a tool head 404 adapted to fit upon the head of a standard hammer to adapt the hammer into a form functionally similar to the hammer 200 of FIG. 2.

The pulling tool may also be embodied in a variety of forms other than as a crowbar or hammer, e.g., it may be provided solely as a pulling tool (without hammer or crowbar structure), as by removing the pounding face and the claw of the hammer 200. The pulling tool could also be provided as a member which clamps or bolts onto preexisting separate tools. For example, considering the hammer 200, the top 204*b* of the tool head 204 (i.e., the part defining the anchor 206, jaw 208, etc.) could be formed as a separate member which can be bolted or otherwise fastened atop a preexisting hammer, so that the hammer could be retrofit to attain the invention. Such an arrangement is illustrated by the exemplary attachment/tool head 404 of FIG. 4, wherein the tool head 404 resembles the tool head 204 insofar as it includes a jaw 408 at the tool head top 404*b* which is rotatable about a pivot 416 to move a jaw grasping face 420 toward an anchor 406 to grasp a nail or other protrusion therebetween. However, here the tool head 404 bears a ring 438 which fits about a hammer head, and resiliently flexible clips 440 which can flex inwardly and outwardly to snap-fit about the hammer's claw. (These flexible clips 440 are shown integrally formed with the tool head 404 in FIG. 4, but may be bolted or otherwise attached to the remainder of the tool head 404, since it can be difficult to cast or otherwise integrally form the entire tool head 404 and attain both the desired hardness at the jaw 408 and the desired flexibility at the clips 440.) The tool head 404 can be attached atop a preexisting hammer by slipping the head/anvil of the hammer within the ring 438 and urging the clips 440 downwardly to snap about the claw of the hammer, so that the hammer handle (more accurately, the entire hammer) extends from the tool head bottom 404*a*. The tool head 404 therefore effectively defines a portion of the hammer head, and the resulting hammer can then be used in the same manner as the hammer 200 of FIGS. 2*a*-2*c*.

Turning to FIG. 5, the pulling tool 500 illustrates a modified version of the crowbar pulling tool 100 of FIG. 1, wherein the pulling tool 500 may be used as a hammer, with the jaw tail 514 defining a hammer head and the jaw tip 512 defining a furcated claw. As in the pulling tool 100, the jaw 508 has a cutout 518 defined by an aperture extending through the jaw 508 from the jaw bearing surface 510, with the tool head top 504*b* and anchor 506 being pivotably fit within the cutout 518. However, here the tool head top 504*b* increases in lateral width as it extends out of the cutout 518 of the jaw 508 toward the anchor bearing surface 544, i.e., the anchor 506 is laterally enlarged. Another difference between the pulling tool 500 and the pulling tool 100 is that the prying wedge 524 at the end of the handle 502 is furcated to assist in fastener removal. The end of the handle 502 further includes a pulling hole 554, wherein a fastener head may be inserted within the pulling hole 554 and the fastener body may then be grasped in an adjoining V-slot 556 for pulling.

Figure 5A:
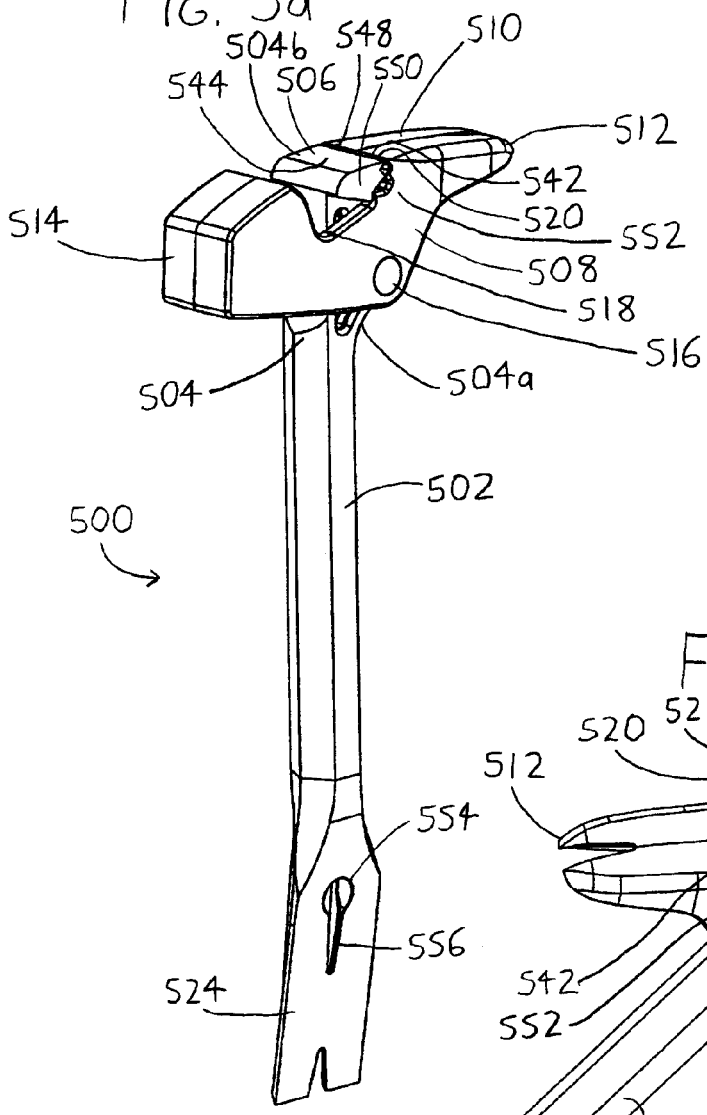
FIGS. 5*a*-5*b* present perspective views of a fifth version of a pulling tool which exemplifies the invention, wherein the pulling tool of FIG. 1 is adapted for use as a hammer, and additionally the anchor 506 is enlarged to laterally extend across the entire width of the jaw 508 so that nail heads or other protrusions may be grasped and pulled at the edges of the jaw 508, as well as at its central region.
Figure 5B:
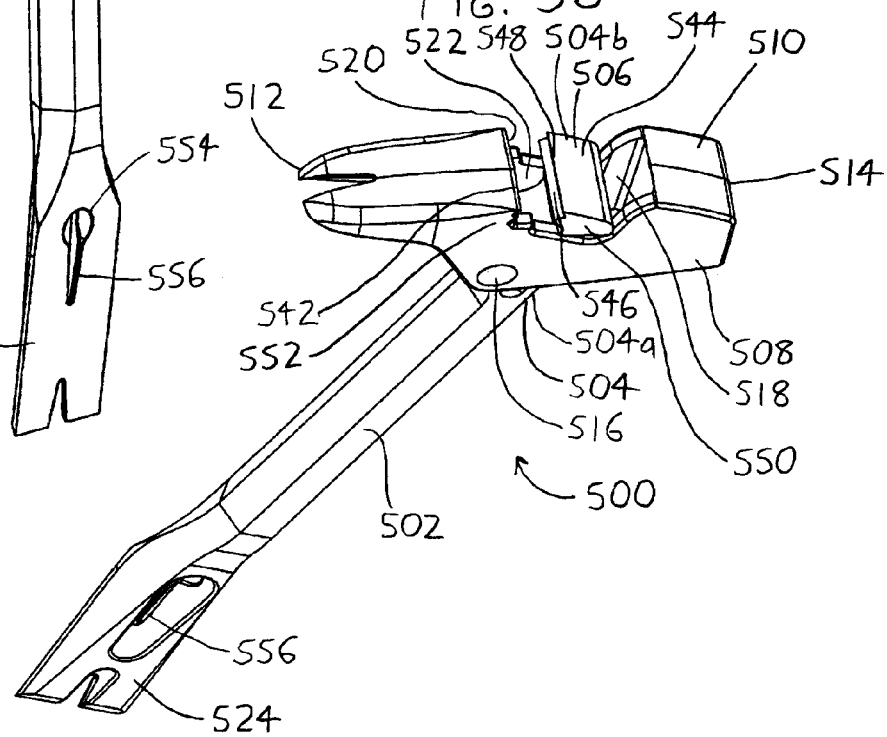

Apart from being used as a hammer rather than as a crowbar, the pulling tool 500 may be used in much the same manner as the pulling tool 100, with a user situating the jaw bearing surface 510 on the surface bearing the nail head or other protrusion, and with the protrusion being situated in the mouth 522 (see FIG. 5B). The user can then actuate the handle 502 toward the jaw tail/hammer head 514 to close the mouth 522 about the protrusion, and may continue pivoting the handle 502 in this direction to remove the protrusion. As the user does so, the jaw tail/hammer head 514 urges against the surface bearing the protrusion, which in turn urges the jaw grasping face 520 toward the anchor 506, maintaining a tight grip on the protrusion as it is levered from the surface.

However, the pulling tool 500 has an advantage over the pulling tool 100, in that the pulling tool 500 is able to pull nails or other protrusions which are closely situated adjacent to some obstruction. Consider the case of a nail head situated in a surface, with some obstruction rising from the surface immediately adjacent the nail: referring particularly to FIGS. 1*b* and 1*d*, it would be difficult to remove the nail using the pulling tool 100 because the bearing surface 110 surrounds the anchor 106, such that the mouth 122 is spaced inwardly from the lateral sides of the jaw 108. Therefore, the jaw 108 may interfere with the obstruction and hinder the user's ability to fit the nail within the mouth 122. However, in the puller 500, the mouth 522 extends across the entire lateral width of the puller 500: the lateral anchor grasping face sides 550 and lateral jaw grasping face sides 552 laterally bound the tool head 504 and jaw 508, and these sides are laterally aligned when the jaws 508 close (as seen in FIG. 5*a*). Thus, one can place the lateral anchor grasping face sides 550 and lateral jaw grasping face sides 552 immediately against the obstruction, and pull the nail/protrusion in standard fashion without interference from the jaw 508. Note that the pulling tool 100 (and the other pulling tools described above) can be modified to include these design features and advantages as well.

An advantage of the pulling tool 500 (as well as the pulling tool 100) is that it is configured to close about a nail head or other protrusion extremely close to the surface from which the protrusion extends. Thus, the pulling tool 500 may easily grasp and pull even protrusions which extend only marginally from a surface. The close approach is accomplished by having the anchor bearing surface 544 and the jaw bearing surface 510 together define a surface or arc which is oriented at least substantially tangentially to a plane extending radially from the pivot 516, at least when the jaw 508 is in the closed state (or nearly so), but preferably when the jaw 508 is at almost any angle with respect to the anchor 506 and handle 502 (most preferably at those angles where the jaw 508 approaches the closed state). Stated differently, the anchor bearing surface 544 and the jaw bearing surface 510—which together define the (preferably curved) top bearing surface of the pulling tool 500, with the mouth 522 being definable within this top bearing surface—always (or almost always) defines a smooth arc, without the anchor bearing surface 544 protruding substantially above or below the jaw bearing surface 510. This feature of the pulling tool 500 has been found to provide superior ability to grasp and remove nail heads or other protrusions which extend only marginally from a surface, particularly insofar as one can more easily "feel" when the protrusion is not fit within the mouth 522: the tool bearing surface defined by the anchor bearing surface 544 and the jaw bearing surface 510 will not be tangentially situated on (will not fully rest on) the nailed surface if the anchor bearing surface 544 or the jaw bearing surface 510 rest on the nail/protrusion, rather than the nail/protrusion being situated in the mouth 522. This close grasping feature is also assisted by arranging the tool head 504 (and its anchor 506), the pivot 516, and the jaw 508 so that the jaw grasping edge 542 and anchor grasping edge 548 (FIGS. 5*b* and 6*b*) are situated at least substantially equidistantly from the pivot 516, with the jaw grasping face 520 and the anchor grasping face 546 being adjacently situated upon (or situated closely adjacent to) a plane extending radially from the pivot 516 (and preferably also aligned along the length of the handle 502), when the jaw 508 is in (or approaches) the closed state. These features help to ensure that the jaw grasping edge 542 and anchor grasping edge 548 are in close alignment as the jaw 508 moves into the closed state to grasp a nail head or other protrusion. Most preferably, the locations at which the jaw grasping edge 542 and anchor grasping edge 548 (FIGS. 5*b* and 6*b*) are situated in the closed state rest on an axis extending along the handle 502 and extending through the pivot 516, or are at least within 10 degrees of this axis (or more preferably, within 5 degrees of this axis).

Figure 6A:
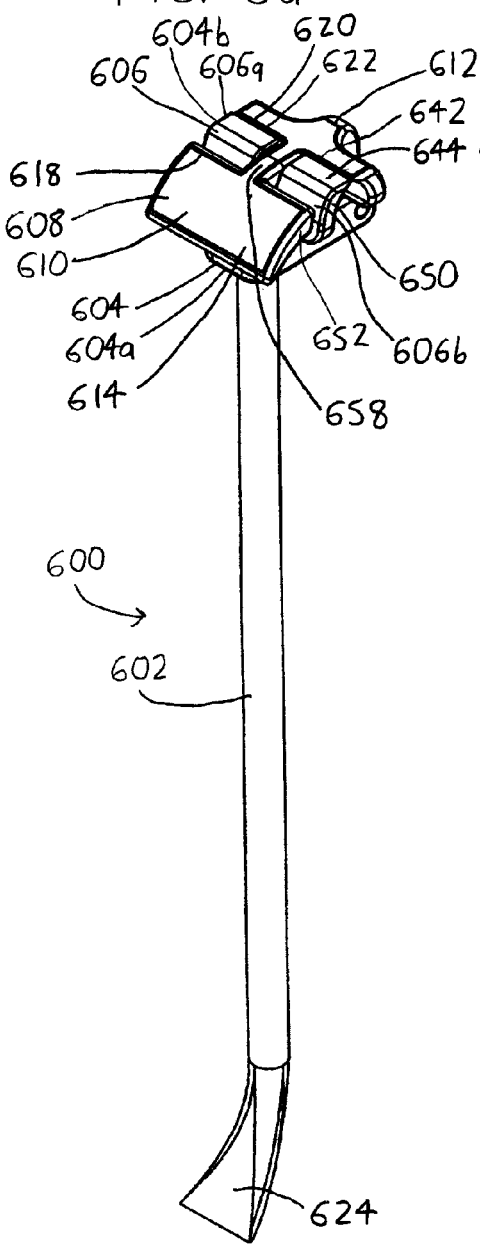
FIGS. 6*a*-6*b* present perspective views of a sixth version of a pulling tool which exemplifies the invention, wherein the pulling tools of FIGS. 2-4 are adapted for use as a stand-alone pulling tool 600 for finishing work, and wherein the mouth 622 extends laterally inwardly from the sides of the jaw 608 so that nail heads or other protrusions may be grasped and pulled at the edges of the jaw 608.
Figure 6B:
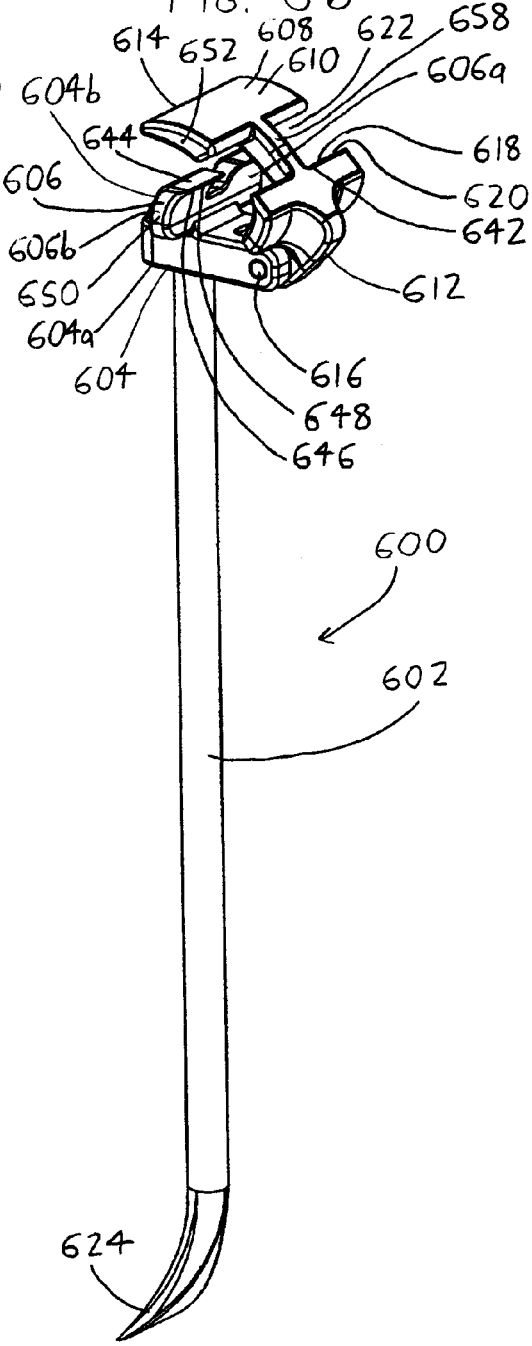

Turning next to FIGS. 6*a* and 6*b*, a pulling tool 600 particularly designed for the pulling of small nails/protrusions (e.g., in cabinetry finishing and fine woodworking applications) is shown, with this pulling tool 600 being intended to have a small size approximating a small screwdriver or the like. (However, it may be differently sized and may be used for different applications if desired.) The puller 600 has a design somewhat similar to those of the pulling tools 200, 300, and 400 of FIGS. 2-4, but rather than providing a cutout as a through-hole in the jaw for receiving the anchor (as in FIGS. 2-4), here the cutout 618 is defined as a pair of indentations laterally inwardly extending from the sides of the jaw 608, such that the jaw 608 has a thin midsection 658 bridging its jaw tip 612 and jaw tail 614. Further, the anchor 606 is furcated into anchor sections 606*a* and 606*b* laterally spaced along a direction parallel to the axis about which the jaw 608 pivots with respect to the tool head 604, with the jaw midsection 658 being at least partially received between the anchor sections 606*a* and 606*b* when the jaw 608 is in the closed state (FIG. 6*a*). This arrangement allows the advantage discussed above with respect to the pulling tool 500, in that the pulling tool 600 is able to pull nails or other protrusions which are closely situated adjacent to some obstruction because the mouth 622 extends laterally inwardly from the sides of the pulling tool 600, rather than being spaced inwardly from the sides of the pulling tool 600 (as in FIGS. 2-4). The pulling tools 200, 300, and 400 of FIGS. 2-4 can be modified to include similar design features to achieve the same advantages.

The invention is not intended to be limited to the preferred versions described above, but rather is intended to be limited only by the claims set out below. Thus, the invention encompasses all different versions that fall literally or equivalently within the scope of these claims.

What is claimed is:

1. A pulling tool for pulling out embedded nails and other protruding objects, the pulling tool comprising:

a. a tool head extending between:

(1) a tool head top terminating in an anchor, and (2) an opposing tool head bottom, wherein the tool head bottom defines an elongated handle;

b. a jaw pivotably and non-translatably affixed to the tool head top, the jaw including:

(1) a jaw bearing surface extending from a jaw tip to a jaw tail, (2) a cutout extending through the jaw from the jaw bearing surface, the cutout being:

(a) situated between the jaw tip and the jaw tail, and (b) bounded on one side by a jaw grasping face;

wherein the jaw pivots with respect to the tool head between:

A. a closed state wherein the anchor rests at least substantially entirely within the cutout closely adjacent the jaw grasping face, whereby a nail or other protrusion may be grasped between the anchor and the jaw grasping face; and B. an open state wherein the jaw grasping face is spaced from the anchor to define a mouth therebetween, whereby a nail or other protrusion may be inserted into or removed from the mouth.

2. The pulling tool of claim 1 wherein:

a. in a direction parallel to the axis about which the jaw pivots with respect to the tool head top, (1) the anchor is bounded by opposing lateral anchor sides, (2) the jaw grasping face is bounded by opposing lateral jaw grasping face sides, and b. the lateral anchor sides and lateral jaw grasping face sides are at least substantially aligned when the jaw is in the closed state.

3. The pulling tool of claim 2 wherein the entirety of the jaw is bounded by planes:

a. coincident with the lateral jaw grasping face sides, and b. oriented perpendicular to the axis about which the jaw pivots with respect to the tool head top.

4. The pulling tool of claim 2 wherein the tool head top has its greatest lateral width at the anchor, with the tool head top having lesser width as it extends away from the anchor.

5. The pulling tool of claim 4 wherein the jaw is laterally bounded by the jaw grasping face sides.

6. The pulling tool of claim 1 wherein, when the jaw is in the closed state, the anchor and the jaw bearing surface are adjacently situated to define a surface oriented at least substantially tangentially to a plane extending radially from the axis about which the jaw pivots.

7. The pulling tool of claim 6 wherein, when the jaw is in the closed state, the jaw grasping face is situated upon or closely adjacent to a plane oriented coincident with or parallel to:

a. at least a substantial portion of the length of the handle, and b. a plane extending radially from the axis about which the jaw pivots.

8. The pulling tool of claim 1 wherein:

a. the anchor includes:

(1) an anchor bearing surface at which the anchor terminates, and (2) an adjacent anchor grasping face, wherein the anchor grasping face rests closely adjacent the jaw grasping face when the jaw is in the closed state, whereby a nail or other protrusion may be grasped between the anchor grasping face and the jaw grasping face;

b. when the jaw is in the closed state:

(1) the anchor bearing surface and the jaw bearing surface are adjacently situated to define a surface oriented at least substantially tangentially to a plane extending radially from the axis about which the jaw pivots;

(2) the anchor grasping face and the jaw grasping face are adjacently situated upon or closely adjacent to a plane extending radially from the axis about which the jaw pivots.

9. The pulling tool of claim 1 wherein:

a. the anchor includes:

(1) an anchor bearing surface at which the anchor terminates;

(2) an adjacent anchor grasping face, wherein the anchor grasping face rests closely adjacent the jaw grasping face when the jaw is in the closed state, whereby a nail or other protrusion may be grasped between the anchor grasping face and the jaw grasping face;

(3) an anchor grasping edge defined between the anchor bearing surface and the anchor grasping face;

b. the jaw includes a jaw grasping edge defined between the jaw bearing surface and the jaw grasping face;

c. when the jaw is in the closed state, the anchor grasping edge and jaw grasping edge are situated upon or closely adjacent to a plane oriented coincident with or parallel to:

(1) at least a substantial portion of the length of the handle, and (2) a plane extending radially from the axis about which the jaw pivots.

10. The pulling tool of claim 1 wherein:

a. the anchor is furcated into anchor sections laterally spaced along a direction parallel to the axis about which the jaw pivots with respect to the tool head top, and b. the jaw, when in the closed state, at least partially extends between the anchor sections.

11. The pulling tool of claim 1 wherein the tool head top:

a. is restrained to remain within the cutout of the jaw, and b. increases in lateral width as it extends out of the cutout of the jaw toward the anchor.

12. The pulling tool of claim 1 wherein:

a. the jaw tip defines a furcated claw, and b. the jaw tail defines a hammer head.

13. The pulling tool of claim 1 wherein the handle terminates in a wedge.

14. A pulling tool for pulling out embedded nails and other protruding objects, the pulling tool comprising:

a. a tool head extending between:

(1) a tool head top, the tool head top having an anchor bearing surface and an adjacent anchor grasping face with an anchor grasping edge defined therebetween, and (2) a tool head bottom from which an elongated handle extends;

b. a jaw having a jaw bearing surface and an adjacent jaw grasping face with a jaw grasping edge defined therebetween;

c. a pivot rotatably joining the jaw to the tool head, whereby the jaw pivots with respect to the tool head between:

(1) an open state wherein a mouth is defined between the anchor grasping face and the jaw grasping face, whereby a nail or other protrusion may be fit into the mouth; and (2) a closed state wherein the mouth is at least substantially closed, with the anchor bearing surface and jaw bearing surface together defining a surface oriented at least substantially tangentially to a plane extending radially from the pivot, wherein:

A. the anchor bearing surface and the jaw bearing surface are adjacently situated to define a surface oriented at least substantially tangentially to a plane extending radially from the axis about which the jaw pivots;

B. the anchor grasping face and the jaw grasping face are adjacently situated upon or closely adjacent to the plane extending radially from the axis about which the jaw pivots, when the jaw is in the closed state.

15. The pulling tool of claim 14 wherein:

a. in a direction parallel to the axis about which the jaw pivots with respect to the tool head top, (1) the anchor is bounded by opposing lateral anchor sides, and (2) the jaw grasping face is bounded by opposing lateral grasping face sides, and b. the lateral anchor sides and lateral grasping face sides are at least substantially aligned when the jaw is in the closed state.

16. The pulling tool of claim 14 wherein:

a. the jaw includes a cutout, the cutout being defined by an aperture extending through the jaw from the jaw bearing surface;

b. the tool head is restrained by the pivot to rotate within the cutout.

17. The pulling tool of claim 16 wherein the tool head increases in lateral width as it extends from the cutout toward the anchor bearing surface.

18. The pulling tool of claim 14 wherein the jaw bearing surface extends between:

a. a jaw tip defining a furcated claw, and b. a jaw tail defining a hammer head.

19. A pulling tool for pulling out embedded nails and other protruding objects, the pulling tool comprising:

a. a tool head which:

(1) extends between an elongated tool handle and an opposing anchor bearing surface, and (2) includes an anchor grasping face adjacent the anchor bearing surface, the anchor grasping face being laterally bounded by anchor grasping face sides;

wherein the tool head has decreasing width as it extends away from the anchor bearing surface and the anchor grasping face, b. a jaw pivotally affixed to the tool head wherein:

(1) the jaw includes:

(a) a jaw bearing surface, and (b) an adjacent jaw grasping face laterally bounded by grasping face sides;

(2) the jaw is pivotable along a laterally-extending axis between:

(a) an open state wherein a mouth is spaced between the jaw grasping face and the anchor grasping face, whereby a nail or other protrusion may be fit into the mouth, and (b) a closed state wherein:

(i) the jaw grasping face and the anchor grasping face are closely adjacently situated, whereby the mouth may be closed about the nail or other protrusion, and (ii) the anchor grasping face sides and jaw grasping face sides are at least substantially aligned.

20. The pulling tool of claim 19 wherein the jaw is laterally bounded by the jaw grasping face sides.

* * * * *